US010176753B2

(12) United States Patent
Wang

(10) Patent No.: US 10,176,753 B2
(45) Date of Patent: Jan. 8, 2019

(54) METHOD AND APPARATUS FOR CONTROLLING BRIGHTNESS OF ORGANIC LIGHT EMITTING DIODE SCREEN

(71) Applicant: Boe Technology Group Co., Ltd., Beijing (CN)

(72) Inventor: Xin Wang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 15/580,650

(22) PCT Filed: Jun. 19, 2017

(86) PCT No.: PCT/CN2017/088942
§ 371 (c)(1),
(2) Date: Dec. 7, 2017

(87) PCT Pub. No.: WO2018/040676
PCT Pub. Date: Mar. 8, 2018

(65) Prior Publication Data

US 2018/0301083 A1 Oct. 18, 2018

(30) Foreign Application Priority Data

Aug. 31, 2016 (CN) ..... 2016 1 0791638

(51) Int. Cl.
*G09G 3/32* (2016.01)
*G09G 3/3225* (2016.01)
*G09G 3/20* (2006.01)

(52) U.S. Cl.
CPC ..... *G09G 3/3225* (2013.01); *G09G 3/2003* (2013.01); *G09G 2300/0452* (2013.01);
(Continued)

(58) Field of Classification Search
CPC .... G09G 3/3208–3/3291; G09G 5/028; G09G 5/10; G09G 2300/04;
(Continued)

(56) References Cited

U.S. PATENT DOCUMENTS

2006/0071886 A1 4/2006 Johnson et al.
2012/0127405 A1* 5/2012 Lee ..... G09G 3/3648 349/106
2016/0232859 A1* 8/2016 Oh ..... G09G 3/3611
2017/0069250 A1 3/2017 Wang et al.

FOREIGN PATENT DOCUMENTS

CN 1777926 A 5/2006
CN 103617778 A 3/2014
(Continued)

OTHER PUBLICATIONS

English translation of CN-103531175-B (Year: 2016).*
(Continued)

*Primary Examiner* — Nathan Danielsen
(74) *Attorney, Agent, or Firm* — Womble Bond Dickinson (US) LLP

(57) ABSTRACT

Embodiments of the present disclosure provide a method and apparatus for controlling brightness of an OLED screen. The method comprises: obtaining brightness of a first sub-pixel in an M-th column of pixels; obtaining brightness of a second sub-pixel; and increasing brightness of the first sub-pixel based on a difference in brightness between the second sub-pixel and the first sub-pixel, if brightness of the second sub-pixel is greater than that of the first sub-pixel.

20 Claims, 3 Drawing Sheets

(52) U.S. Cl.
CPC ..... *G09G 2310/0232* (2013.01); *G09G 2320/0233* (2013.01); *G09G 2320/0646* (2013.01); *G09G 2320/0686* (2013.01)

(58) Field of Classification Search
CPC ... G09G 2300/0452; G09G 2310/0218; G09G 2310/0232; G09G 2320/0233; G09G 2320/0242; G09G 2320/0271; G09G 2320/0276; G09G 2320/029; G09G 2320/0295; G09G 2320/0626–2320/0666; G09G 2320/0686; G09G 2340/08
See application file for complete search history.

(56) References Cited

FOREIGN PATENT DOCUMENTS

| | | | | |
|---|---|---|---|---|
| CN | 104751767 | A | | 7/2015 |
| CN | 103531175 | B | * | 8/2016 |
| CN | 105825797 | A | | 8/2016 |
| CN | 106297656 | A | | 1/2017 |
| KR | 20160069576 | A | | 6/2016 |

OTHER PUBLICATIONS

International Search Report and Written Opinion in PCT/CN2017/088942 dated Sep. 11, 2017, with English translation.
Office Action in Chinese Application No. 201610791638.0 dated May 9, 2017, with English translation.
Office Action in Chinese Application No. 201610791638.0 dated Aug. 18, 2017, with English translation.
Office Action received for Chinese Patent Application No. 201610791638.0, dated Dec. 13, 2017, 4 pages (1 page of English Translation and 3 pages of Office Action).
Chinese Search Report received for CN Patent Application No. 201610791638.0, dated Feb. 16, 2017, 9 pages (3 pages of English Translation and 6 pages of Original Document).

* cited by examiner

METHOD AND APPARATUS FOR CONTROLLING BRIGHTNESS OF ORGANIC LIGHT EMITTING DIODE SCREEN

RELATED APPLICATIONS

The present application is the U.S. national phase entry of PCT/CN2017/088942, with an international filling date of Jun. 19, 2017, which claims the priority of the Chinese patent application No. 201610791638.0 filed on Aug. 31, 2016, the disclosures thereof are referenced herein in their entirety as part of the present application.

FIELD

The present disclosure relates to the field of display technology, and in particular, to a method and apparatus for controlling brightness of an organic light emitting diode (OLED for short) screen.

BACKGROUND

OLED technology is an important branch of display technology. In a conventional OLED display panel, each pixel consists of three sub-pixels, red (R), green (G) and blue (B). As the display panel is higher and higher in resolution, a display panel emerges, which employs four sub-pixels GGRB to constitute two pixels. The display panel achieves normal display of individual pixels by borrowing colors. In this case, borrowing colors means that a pixel achieves display of its own color by means of colors of light emitted by sub-pixels in surrounding pixels.

In a display panel borrowing colors, it is impossible to achieve brightness control over all the sub-pixels, since the number of sub-pixels is large, whereas the number of channels of one driving integrated circuit (IC for short) is limited. Thus, a scheme where two driving ICs are adopted for display control occurs. In general, the two driving ICs control a left half and a right half of the display panel respectively.

However, since no communication is possible between the two ICs controlling the display panel, one IC thereof cannot obtain data for the other IC driven sub-pixels, such that there might be subtle differences between brightness of sub-pixels controlled by the two ICs. This results in a case where brightness of pixels at the border of regions controlled by the two ICs might be lower than that of other pixels, thereby producing saw-tooth defects.

SUMMARY

In view of above, what is desired is to mitigate or eliminate display defects at the border of different regions driven by multiple ICs in an OLED display panel.

According to an aspect, an embodiment of the present disclosure provides a method for controlling brightness of an organic light emitting diode (OLED) screen, wherein the OLED screen comprises at least two regions and the at least two regions are driven by at least two ICs respectively. The method comprising:

obtaining brightness of a first sub-pixel in an M-th column of pixels, wherein the first sub-pixel is one of a plurality of sub-pixels with a same color in the M-th column of pixels, and the M-th column of pixels is one of N columns of pixels located in one of the at least two regions and close to a border between the one region and another region, wherein M is a positive integer, and N is a positive integer less than or equal to 3;

obtaining brightness of a second sub-pixel, wherein the second sub-pixel is located within a set range of the first sub-pixel, the second sub-pixel and the first sub-pixel are driven by a same IC, and a distance between a column of pixels where the second sub-pixel is located and the border is greater than a distance between the M-th column of pixels and the border; and increasing brightness of the first sub-pixel based on a difference in brightness between the second sub-pixel and the first sub-pixel, if brightness of the second sub-pixel is greater than that of the first sub-pixel.

According to a further embodiment, the step of obtaining brightness of a first sub-pixel in an M-th column of pixels comprises:

obtaining a data signal corresponding to the first sub-pixel; and determining brightness of the first sub-pixel according to a correspondence between data signals and brightness.

According to a further embodiment, the step of increasing brightness of the first sub-pixel based on a difference in brightness between the second sub-pixel and the first sub-pixel, if brightness of the second sub-pixel is greater than that of the first sub-pixel, comprises:

calculating a brightness ratio of the first sub-pixel, wherein the brightness ratio of the first sub-pixel is a ratio of a difference in brightness between the second sub-pixel and the first sub-pixel to the brightness of the second sub-pixel; and increasing brightness of the first sub-pixel if the brightness ratio of the first sub-pixel is greater than a set value, wherein the set value is greater than 0 and less than 1.

According to a further embodiment, the set value is in a range between 65%-75%.

According to a further embodiment, the step of increasing brightness of the first sub-pixel if the brightness ratio of the first sub-pixel is greater than a set value, comprises:

increasing brightness of the first sub-pixel by a target brightness, wherein the target brightness, the brightness of the second sub-pixel, the brightness ratio, and the set value satisfy an equation of: the target brightness=the brightness of the second sub-pixel×(the brightness ratio−the set value)/2.

According to a further embodiment, the OLED screen displays a monochromatic display, and the first sub-pixel and the second sub-pixel are sub-pixels with a same color.

According to a further embodiment, the OLED screen displays a non-monochromatic display, and the first sub-pixel and the second sub-pixel are sub-pixels with different colors.

According to a further embodiment, the method further comprises: obtaining data signals for sub-pixels driven by the at least two ICs; and determining whether the OLED screen displays a monochromatic display according to the data signals for the sub-pixels driven by the at least two ICs.

According to a further embodiment, odd rows of sub-pixels of the OLED screen is in an arrangement of R, G, B, and G, and even rows of sub-pixels of the OLED screen is in an arrangement of B, G, R, and G.

According to a further embodiment, the first sub-pixel has a set range such that a difference in row number between a row of pixels where the second sub-pixel is located and a row of pixels where the first sub-pixel is located is less than a first threshold, and a difference in column number between a column of pixels where the second sub-pixel is located and a column of pixels where the first sub-pixel is located is less than a second threshold, wherein the first threshold and the second threshold are both positive integers between 2 and 5.

According to another aspect, an embodiment of the present disclosure further provides an apparatus for controlling brightness of an organic light emitting diode (OLED) screen, wherein the OLED screen comprises at least two regions and the at least two regions are driven by at least two ICs respectively. The apparatus comprises:

a first obtaining circuit configured to obtain brightness of a first sub-pixel in an M-th column of pixels, wherein the first sub-pixel is one of a plurality of sub-pixels with a same color in the M-th column of pixels, and the M-th column of pixels is one of N columns of pixels located in one of the at least two regions and close to a border between the one region and another region, wherein M is a positive integer, and N is a positive integer less than or equal to 3;

a second obtaining circuit configured to obtain brightness of a second sub-pixel, wherein the second sub-pixel is located within a set range of the first sub-pixel, the second sub-pixel and the first sub-pixel are driven by a same IC, and a distance between a column of pixels where the second sub-pixel is located and the border is greater than a distance between the M-th column of pixels and the border; and a processor configured to increase brightness of the first sub-pixel based on a difference in brightness between the second sub-pixel and the first sub-pixel, if brightness of the second sub-pixel is greater than that of the first sub-pixel.

According to a further embodiment, the first obtaining circuit is further configured to obtain a data signal corresponding to the first sub-pixel; and determine brightness of the first sub-pixel according to a correspondence between data signals and brightness.

According to a further embodiment, the processor is further configured to calculate a brightness ratio of the first sub-pixel, wherein the brightness ratio of the first sub-pixel is a ratio of a difference in brightness between the second sub-pixel and the first sub-pixel to the brightness of the second sub-pixel; and increase brightness of the first sub-pixel if the brightness ratio of the first sub-pixel is greater than a set value, wherein the set value is greater than 0 and less than 1.

According to a further embodiment, the set value is in a range between 65%-75%.

According to a further embodiment, the processor is further configured to increase brightness of the first sub-pixel by a target brightness, wherein the target brightness, the brightness of the second sub-pixel, the brightness ratio, and the set value satisfy an equation of: the target brightness=the brightness of the second sub-pixel×(the brightness ratio−the set value)/2.

According to a further embodiment, the OLED screen displays a monochromatic display, and the first sub-pixel and the second sub-pixel are sub-pixels with a same color.

According to a further embodiment, the OLED screen displays a non-monochromatic display, and the first sub-pixel and the second sub-pixel are sub-pixels with different colors.

According to a further embodiment, the processor is further configured to obtain data signals for sub-pixels driven by the at least two ICs; and determine whether the OLED screen displays a monochromatic display according to the data signals for the sub-pixels driven by the at least two ICs.

According to a further embodiment, odd rows of sub-pixels of the OLED screen are in an arrangement of R, G, B, and G, and even rows of sub-pixels of the OLED screen are in an arrangement of B, G, R, and G.

BRIEF DESCRIPTION OF THE DRAWINGS

In order to illustrate the technical solutions in embodiments of the present disclosure more clearly, the appended drawings needed to be used in description of the embodiments will be introduced briefly in the following. Obviously, the drawings in the following description are only some embodiments of the present disclosure. For those of ordinary skills in the art, other drawings may also be obtained according to these drawings under the premise of not paying out creative work.

DETAILED DESCRIPTION OF THE EMBODIMENTS

In the following, implementations of the present disclosure will be further described in detail in conjunction with the drawings, so as to make the objects, technical solutions and advantages of the present disclosure clearer.

For the convenience of understanding a technical solution provided by an embodiment of the present disclosure, an application scenario of embodiments of the present disclosure will be introduced first. One OLED screen may be controlled by at least two ICs. For example, an OLED screen may comprise at least two regions, and each IC drives one region of the OLED screen.

Figure 1:
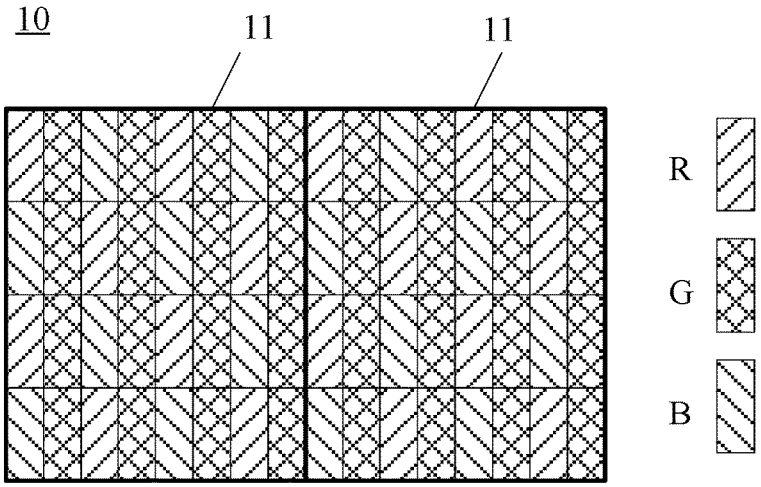
FIG. 1 is a schematic diagram for an application scenario of an OLED provided by an embodiment of the present disclosure.

In connection with FIG. 1, a case where two ICs drive two regions of the OLED screen respectively will be taken as an example for illustration. As shown in FIG. 1, the OLED screen 10 comprises two regions 11. Each region is driven by one IC. Within the two regions of the OLED screen, sub-pixels are arranged according to the same rule. For example, as shown in FIG. 1, odd rows of sub-pixels of the OLED screen are in an arrangement of R (red), G (green), B (blue) and G (green), and even rows of sub-pixels of the OLED screen are in an arrangement of B, G, R and G.

Figure 2:
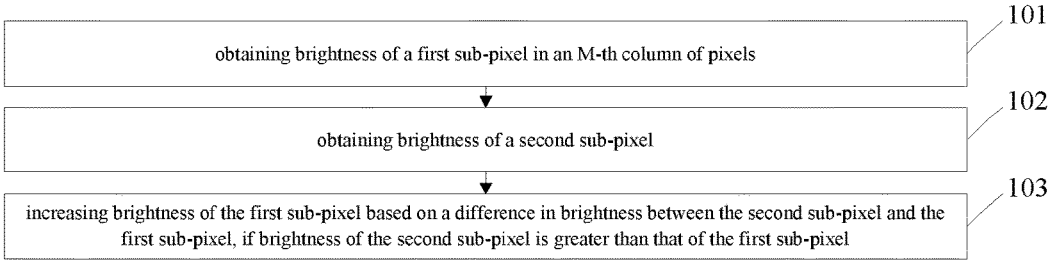
FIG. 2 is a flow chart of a method for controlling brightness of an OLED screen provided by an embodiment of the present disclosure.

FIG. 2 is a flow chart of a method for controlling brightness of an organic light emitting diode (OLED) screen provided by an embodiment of the present disclosure. The OLED screen comprises at least two regions and the at least two regions are driven by at least two ICs respectively. With reference to FIG. 2, the method comprises the following steps.

At step 101, brightness of a first sub-pixel in an M-th column of pixels is obtained. The first sub-pixel is one of a plurality of sub-pixels with a same color in the M-th column of pixels, and the M-th column of pixels is one of N columns of pixels located in one of the at least two regions and close to a border between the one region and another region. M is a positive integer, and N is a positive integer less than or equal to 3.

At step 102, brightness of a second sub-pixel is obtained. The second sub-pixel is located within a set range of the first sub-pixel. The second sub-pixel and the first sub-pixel are driven by a same IC. Further, a distance between the column of pixels where the second sub-pixel is located and the border is greater than a distance between the M-th column of pixels and the border.

The first sub-pixel for example may have a set range such that a difference in row number between the row of pixels where the second sub-pixel is located and the row of pixels where the first sub-pixel is located is less than a first threshold, and a difference in column number between the column of pixels where the second sub-pixel is located and the column of pixels where the first sub-pixel is located is less than a second threshold. Both the first threshold and the second threshold may be positive integers between 2 and 5.

At step 103, brightness of the first sub-pixel is increased based on a difference in brightness between the second sub-pixel and the first sub-pixel, if brightness of the second sub-pixel is greater than that of the first sub-pixel.

In the method for controlling brightness of an OLED screen according to an embodiment of the present disclosure, brightness of the first sub-pixel and brightness of the second sub-pixel are obtained respectively, and further, brightness of the first sub-pixel is increased based on a difference in brightness between the second sub-pixel and the first sub-pixel, if brightness of the second sub-pixel is greater than that of the first sub-pixel. The M-th column of pixels is one of N columns of pixels located in one of the at least two regions and close to a border between the one region and another region. That is, the first sub-pixel is a sub-pixel close to the border. The brightness of the first sub-pixel is increased according to the brightness of the first sub-pixel and the brightness of the second sub-pixel, which can mitigate or eliminate saw-tooth defects, and thereby improve the display effect.

Figure 3:
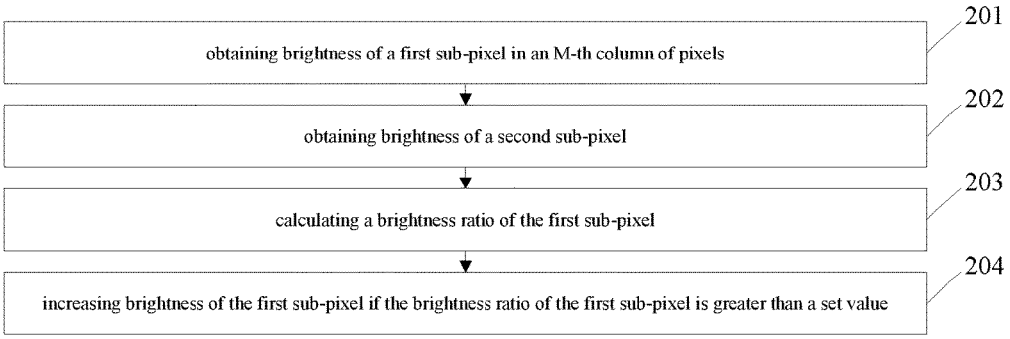
FIG. 3 is a flow chart of another method for controlling brightness of an OLED screen provided by an embodiment of the present disclosure.

FIG. 3 is a flow chart of another method for controlling brightness of an OLED screen provided by an embodiment of the present disclosure. The OLED screen comprises at least two regions and the at least two regions are driven by at least two ICs respectively. With reference to FIG. 3, the method comprises the following steps.

At step 201, brightness of a first sub-pixel in an M-th column of pixels is obtained. The first sub-pixel is one of a plurality of sub-pixels with a same color in the M-th column of pixels, and the M-th column of pixels is one of N columns of pixels located in one of the at least two regions and close to the border between the one region and another region. M is a positive integer, and N is a positive integer less than or equal to 3.

According to a further embodiment, N is 2.

According to a further embodiment, the step of obtaining brightness of a first sub-pixel in an M-th column of pixels may comprise:

obtaining a data signal corresponding to the first sub-pixel; and determining brightness of the first sub-pixel according to a correspondence between data signals and brightness.

The brightness of a sub-pixel can be obtained accurately by a data signal corresponding to the sub-pixel. The data signal is generally provided to the sub-pixel by an IC via a data line. The correspondence between data signals and brightness may be predefined and stored in storage. Therefore, the brightness of the first sub-pixel may be determined according to the data signal corresponding to the first sub-pixel.

At step 202, brightness of a second sub-pixel is obtained. The second sub-pixel is located within a set range of the first sub-pixel. The second sub-pixel and the first sub-pixel are driven by the same IC, and a distance between the column of pixels where the second sub-pixel is located and the border is greater than a distance between the M-th column of pixels and the border.

The first sub-pixel for example may have a set range such that a difference in row number between the row of pixels where the second sub-pixel is located and the row of pixels where the first sub-pixel is located is less than a first threshold, and a difference in column number between the column of pixels where the second sub-pixel is located and the column of pixels where the first sub-pixel is located is less than a second threshold. Both the first threshold and the second threshold may be positive integers between 2 and 5.

According to a further embodiment, both the first threshold and the second threshold are 2.

According to a further embodiment, the step of obtaining brightness of a second sub-pixel may comprise:

obtaining a data signal corresponding to the second sub-pixel; and determining brightness of the second sub-pixel according to the correspondence between data signals and brightness.

The brightness of a sub-pixel can be obtained accurately by a data signal corresponding to the sub-pixel.

At step 203, a brightness ratio of the first sub-pixel is calculated. The brightness ratio of the first sub-pixel is a ratio of a difference in brightness between the second sub-pixel and the first sub-pixel to the brightness of the second sub-pixel.

At step 204, the brightness of the first sub-pixel is increased if the brightness ratio of the first sub-pixel is greater than a set value. The set value is greater than 0 and less than 1.

According to a further embodiment, the set value is in a range between 65%-75%. The set value is set between 65%-75%, such that brightness adjustment will be only performed when a difference in brightness between sub-pixels reaches a relatively large value (65%-75%), so as to mitigate or eliminate defects.

According to a further embodiment, the set value may be 70%.

According to a further embodiment, the step of increasing brightness of the first sub-pixel if the brightness ratio of the first sub-pixel is greater than a set value may comprise: increasing brightness of the first sub-pixel by a target brightness. The target brightness, the brightness of the second sub-pixel, the brightness ratio, and the set value satisfy an equation of: the target brightness=the brightness of the second sub-pixel×(the brightness ratio−the set value)/2.

Increase brightness in such a manner achieves effects such as increasing brightness of a sub-pixel, and also will not increase brightness of the sub-pixel too much.

For example, supposing that the brightness ratio is 80%, and the set value is 70%, the target brightness is the brightness of the second sub-pixel×5%.

In a method for controlling brightness of an OLED screen according to an embodiment of the present disclosure, the brightness of the first sub-pixel and the brightness of the second sub-pixel are obtained respectively. Further, the brightness of the first sub-pixel is increased based on a difference in brightness between the second sub-pixel and the first sub-pixel, if the brightness of the second sub-pixel is greater than that of the first sub-pixel. The M-th column of pixels is one of N columns of pixels located in one of the at least two regions and close to the border between the one region and another region. That is, the first sub-pixel is a sub-pixel close to the border. The brightness of the first sub-pixel is increased if the brightness of the first sub-pixel is less than that of the second sub-pixel and the brightness ratio of the first sub-pixel is greater than the set value. Thus, saw-tooth defects can be mitigated or eliminated, thereby improving the display effect.

Typically, the OLED screen displays in two modes, a monochromatic display and a non-monochromatic display. Thus, brightness control may further be conducted for the OLED screen in the two modes respectively, on a basis of the method provided by FIG. 3.

Figure 4A:
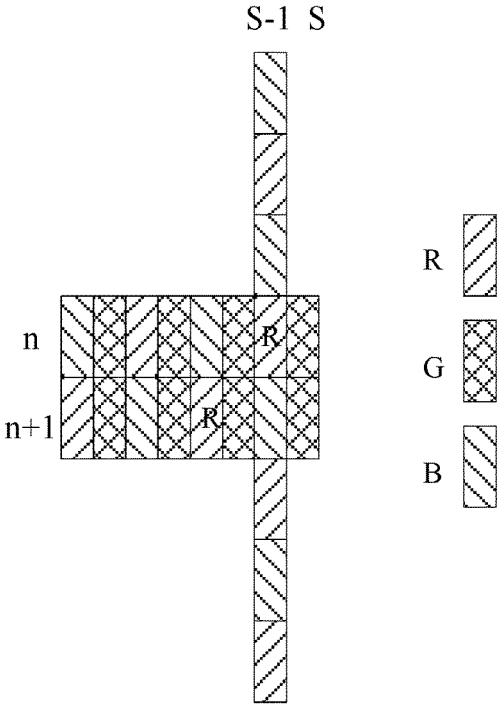
FIG. 4A is a distribution diagram for part of sub-pixels in an OLED screen provided by an embodiment of the present disclosure.

The first mode is a monochromatic display mode. When the OLED screen exhibits a monochromatic display, the first sub-pixel and the second sub-pixel are sub-pixels with a same color. For example, as shown in FIG. 4A, an R (red) sub-pixel in the (S−1)-th column is taken as the first sub-pixel (e.g., the R sub-pixel in the (S−1)-th column and the n-th row), and the R sub-pixel in the (S−3)-th column and the (n+1)-th row is taken as the second sub-pixel. Brightness of the first sub-pixel and the second sub-pixel are determined. The brightness of the first sub-pixel is increased if the brightness ratio of the first sub-pixel is greater than the set value.

Figure 4B:
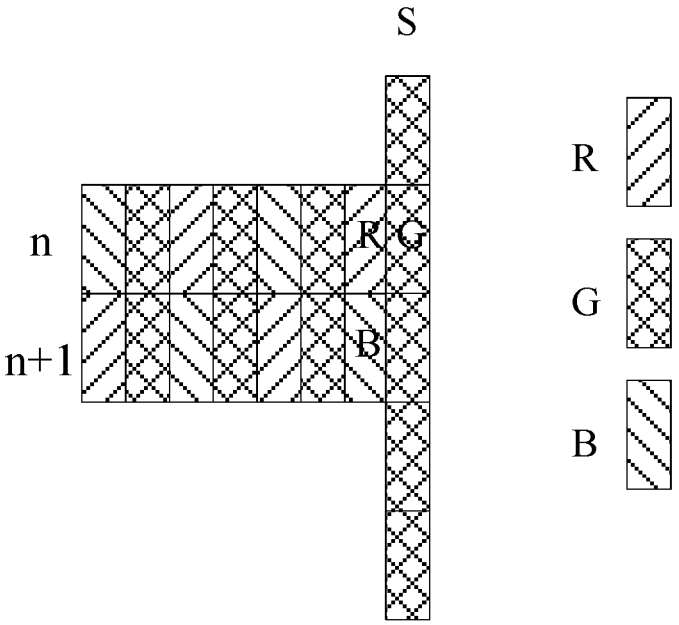
FIG. 4B is a distribution diagram for part of sub-pixels in another OLED screen provided by an embodiment of the present disclosure.

The second mode is a non-monochromatic display mode. When the OLED screen gives a non-monochromatic display, the first sub-pixel and the second sub-pixel are sub-pixels with different colors. For example, as shown in FIG. 4B, a G (green) sub-pixel in the S-th column is taken as the first sub-pixel (e.g., the G sub-pixel in the S-th column and the n-th row), and the R sub-pixel in the (S−1)-th column and the n-th row is taken as the second sub-pixel. Alternatively, a G (green) sub-pixel in the S-th column is taken as the first sub-pixel (e.g., the G sub-pixel in the S-th column and the n-th row), and the B (blue) sub-pixel in the (S−1)-th column and the (n+1)-th row is taken as the second sub-pixel. Brightness of the first sub-pixel and the second sub-pixel are determined. The brightness of the first sub-pixel is increased if the brightness ratio of the first sub-pixel is greater than the set value.

Sub-pixels with a same color or different colors are selected respectively for brightness comparison according to whether the screen gives a monochromatic display or a non-monochromatic display. In this way, brightness control is achieved for the OLED screen in different display modes respectively, thereby mitigating or eliminating defects.

According to a further embodiment, the method for controlling brightness of an OLED screen may further comprise: obtaining data signals for sub-pixels driven by the at least two ICs; and determining whether the OLED screen displays a monochromatic display according to the data signals for the sub-pixels driven by the at least two ICs. For example, when the data signals outputted by an IC to the sub-pixels in each pixel are identical, it may be determined that the OLED screen provides a monochromatic display. Determining whether a screen is in a monochromatic display according to the data signals for the sub-pixels driven by an IC is simple and convenient.

Figure 5:
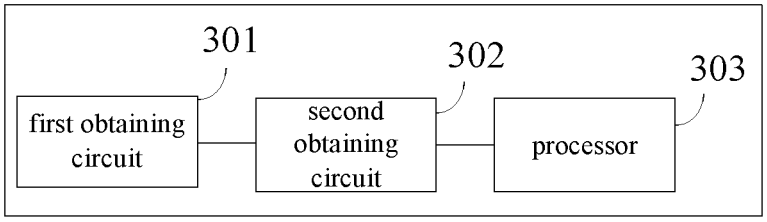
FIG. 5 is a structural diagram of an apparatus for controlling brightness of an OLED screen provided by an embodiment of the present disclosure.

FIG. 5 is a structural diagram of an apparatus for controlling brightness of an organic light emitting diode (OLED) screen provided by an embodiment of the present disclosure. The OLED screen comprises at least two regions and the at least two regions are driven by at least two ICs respectively. With reference to FIG. 5, the apparatus comprises the following portions:

a first obtaining circuit 301 configured to obtain brightness of a first sub-pixel in an M-th column of pixels, wherein the first sub-pixel is one of a plurality of sub-pixels with a same color in the M-th column of pixels, and the M-th column of pixels is one of N columns of pixels located in one of the at least two regions and close to the border between the one region and another region, wherein M is a positive integer, and N is a positive integer less than or equal to 3;

a second obtaining circuit 302 configured to obtain brightness of a second sub-pixel, wherein the second sub-pixel is located within a set range of the first sub-pixel, the second sub-pixel and the first sub-pixel are driven by the same IC, and a distance between the column of pixels where the second sub-pixel is located and the border is greater than a distance between the M-th column of pixels and the border; and a processor 303 configured to increase brightness of the first sub-pixel based on a difference in brightness between the second sub-pixel and the first sub-pixel, if brightness of the second sub-pixel is greater than that of the first sub-pixel.

In an apparatus for controlling the brightness of an OLED screen according to an embodiment of the present disclosure, the brightness of the first sub-pixel and the brightness of the second sub-pixel are obtained respectively. Further, the brightness of the first sub-pixel is increased based on a difference in brightness between the second sub-pixel and the first sub-pixel, if the brightness of the second sub-pixel is greater than that of the first sub-pixel. The M-th column of pixels is one of N columns of pixels located in one of the at least two regions and close to the border between the one region and another region. That is, the first sub-pixel is a sub-pixel close to the border. The brightness of the first sub-pixel is increased according to the brightness of the first sub-pixel and the brightness of the second sub-pixel. This helps to mitigate or eliminate saw-tooth defects, and thereby improve the display effect.

The first sub-pixel for example may have a set range such that a difference in row number between the row of pixels where the second sub-pixel is located and the row of pixels where the first sub-pixel is located is less than a first threshold, and a difference in column number between the column of pixels where the second sub-pixel is located and the column of pixels where the first sub-pixel is located is less than a second threshold. Both the first threshold and the second threshold may be positive integers between 2 and 5.

According to a further embodiment of the present disclosure, the first obtaining circuit 301 is further configured to obtain a data signal corresponding to the first sub-pixel; and determine brightness of the first sub-pixel according to a correspondence between data signals and brightness.

The brightness of a sub-pixel can be obtained accurately by a data signal corresponding to the sub-pixel. The data signal is generally provided to the sub-pixel by an IC via a data line. The correspondence between data signals and brightness may be predefined and stored in storage. Therefore, the brightness of the first sub-pixel may be determined according to the data signal corresponding to the first sub-pixel.

According to a further embodiment of the present disclosure, the processor 303 is further configured to calculate a brightness ratio of the first sub-pixel, and the brightness ratio of the first sub-pixel is a ratio of a difference in brightness between the second sub-pixel and the first sub-pixel to the brightness of the second sub-pixel; and increase the brightness of the first sub-pixel if the brightness ratio of the first sub-pixel is greater than a set value. The set value is greater than 0 and less than 1. The brightness of the first sub-pixel is increased if the brightness of the first sub-pixel is less than that of the second sub-pixel and the brightness ratio of the first sub-pixel is greater than the set value. This helps to mitigate or eliminate saw-tooth defects, thereby improving the display effect.

According to a further embodiment of the present disclosure, the set value is in a range between 65%-75%. The set value is set between 65%-75%, such that brightness adjustment will be only performed when a difference in brightness between sub-pixels is too large, so as to mitigate or eliminate defects.

According to a further embodiment, the set value may be 70%.

According to a further embodiment of the present disclosure, the processor 303 is further configured to increase the brightness of the first sub-pixel by a target brightness. The target brightness, the brightness of the second sub-pixel, the brightness ratio, and the set value satisfy an equation of: the target brightness=the brightness of the second sub-pixel×(the brightness ratio−the set value)/2.

Increasing brightness in this way helps to achieve effects such as increasing the brightness of a sub-pixel, and also will not increase the brightness of the sub-pixel too much.

For example, supposing that the brightness ratio is 80%, and the set value is 70%, the target brightness is the brightness of the second sub-pixel×5%.

According to a further embodiment of the present disclosure, the OLED screen displays a monochromatic display, and the first sub-pixel and the second sub-pixel are sub-pixels with a same color.

According to a further embodiment of the present disclosure, the OLED screen displays a non-monochromatic display, and the first sub-pixel and the second sub-pixel are sub-pixels with different colors.

Sub-pixels with a same color or different colors are respectively selected for brightness comparison according to whether the screen displays a monochromatic display or a non-monochromatic display. This helps to achieve brightness control of the OLED screen in different display modes respectively, thereby mitigating or eliminating defects.

According to a further embodiment, the processor 303 is further configured to obtain data signals for sub-pixels driven by the at least two ICs; and determine whether the OLED screen displays a monochromatic display according to the data signals for the sub-pixels driven by the at least two ICs. Determining whether a screen is in a monochromatic display according to the data signals for the sub-pixels driven by an IC is simple and convenient.

According to a further embodiment of the present disclosure, odd rows of sub-pixels of the OLED screen are in an arrangement of R, G, B, and G, and even rows of sub-pixels of the OLED screen are in an arrangement of B, G, R, and G.

Those skilled in the art may clearly understand that, for the convenience and simplicity of description, specific working procedures of the above-described apparatus and circuits may refer to the corresponding procedures in the foregoing method embodiments, and will not be repeated herein.

What described above is just part of embodiments of the present disclosure, which are not intended for limiting the present disclosure. Within the spirit and principle of the present disclosure, any modifications, equivalent substitutions, and improvements, etc. that can be made should be comprised in the protection scope of the present disclosure.

The invention claimed is:

1. A method for controlling brightness of an OLED screen, wherein the OLED screen comprises at least two regions and the at least two regions are driven by at least two ICs respectively, the method comprising:

obtaining brightness of a first sub-pixel in an M-th column of pixels, wherein the first sub-pixel is one of a plurality of sub-pixels with a same color in the M-th column of pixels, and the M-th column of pixels is one of N columns of pixels located in one of the at least two regions and close to a border between the one region and another region, wherein M is a positive integer, and N is a positive integer less than or equal to 3;

obtaining brightness of a second sub-pixel, wherein the second sub-pixel is located within a set range of the first sub-pixel, the second sub-pixel and the first sub-pixel are driven by a same IC, and a distance between a column of pixels where the second sub-pixel is located and the border is greater than a distance between the M-th column of pixels and the border; and increasing brightness of the first sub-pixel based on a difference in brightness between the second sub-pixel and the first sub-pixel, if brightness of the second sub-pixel is greater than that of the first sub-pixel.

2. The method as claimed in claim 1, wherein the step of obtaining brightness of a first sub-pixel in an M-th column of pixels comprises:

obtaining a data signal corresponding to the first sub-pixel; and determining brightness of the first sub-pixel according to a correspondence between data signals and brightness.

3. The method as claimed in claim 1, wherein the step of increasing brightness of the first sub-pixel based on a difference in brightness between the second sub-pixel and the first sub-pixel, if brightness of the second sub-pixel is greater than that of the first sub-pixel, comprises:

calculating a brightness ratio of the first sub-pixel, wherein the brightness ratio of the first sub-pixel is a ratio of a difference in brightness between the second sub-pixel and the first sub-pixel to the brightness of the second sub-pixel; and increasing brightness of the first sub-pixel if the brightness ratio of the first sub-pixel is greater than a set value, wherein the set value is greater than 0 and less than 1.

4. The method as claimed in claim 3, wherein the set value is in a range between 65%-75%.

5. The method as claimed in claim 3, wherein the step of increasing brightness of the first sub-pixel if the brightness ratio of the first sub-pixel is greater than a set value, comprises:

increasing brightness of the first sub-pixel by a target brightness, wherein the target brightness, the brightness of the second sub-pixel, the brightness ratio, and the set value satisfy an equation of: the target brightness=the brightness of the second sub-pixel×(the brightness ratio−the set value)/2.

6. The method as claimed in claim 1, wherein the OLED screen displays a monochromatic display, and the first sub-pixel and the second sub-pixel are sub-pixels with a same color.

7. The method as claimed in claim 6, further comprising:

obtaining data signals for sub-pixels driven by the at least two ICs; and determining whether the OLED screen displays a monochromatic display according to the data signals for the sub-pixels driven by the at least two ICs.

8. The method as claimed in claim 1, wherein the OLED screen displays a non-monochromatic display, and the first sub-pixel and the second sub-pixel are sub-pixels with different colors.

9. The method as claimed in claim 8, further comprising:

obtaining data signals for sub-pixels driven by the at least two ICs; and determining whether the OLED screen displays a monochromatic display according to the data signals for the sub-pixels driven by the at least two ICs.

10. The method as claimed in claim 1, wherein odd rows of sub-pixels of the OLED screen are in an arrangement of R, G, B, and G, and even rows of sub-pixels of the OLED screen are in an arrangement of B, G, R, and G.

11. The method as claimed in claim 1, wherein the first sub-pixel has a set range, such that a difference in row number between a row of pixels where the second sub-pixel is located and a row of pixels where the first sub-pixel is located is less than a first threshold, and a difference in column number between a column of pixels where the second sub-pixel is located and a column of pixels where the first sub-pixel is located is less than a second threshold, wherein the first threshold and the second threshold are both positive integers between 2 and 5.

12. An apparatus for controlling brightness of an OLED screen, wherein the OLED screen comprises at least two regions and the at least two regions are driven by at least two ICs respectively, the apparatus comprising:

a first obtaining circuit configured to obtain brightness of a first sub-pixel in an M-th column of pixels, wherein the first sub-pixel is one of a plurality of sub-pixels with a same color in the M-th column of pixels, and the M-th column of pixels is one of N columns of pixels located in one of the at least two regions and close to a border between the one region and another region, where M is a positive integer, and N is a positive integer less than or equal to 3;

a second obtaining circuit configured to obtain brightness of a second sub-pixel, wherein the second sub-pixel is located within a set range of the first sub-pixel, the second sub-pixel and the first sub-pixel are driven by a same IC, and a distance between a column of pixels where the second sub-pixel is located and the border is greater than a distance between the M-th column of pixels and the border; and a processor configured to increase brightness of the first sub-pixel based on a difference in brightness between the second sub-pixel and the first sub-pixel, if brightness of the second sub-pixel is greater than that of the first sub-pixel.

13. The apparatus as claimed in claim 12, wherein the first obtaining circuit is further configured to obtain a data signal corresponding to the first sub-pixel; and determine brightness of the first sub-pixel according to a correspondence between data signals and brightness.

14. The apparatus as claimed in claim 12, wherein the processor is further configured to calculate a brightness ratio of the first sub-pixel, wherein the brightness ratio of the first sub-pixel is a ratio of a difference in brightness between the second sub-pixel and the first sub-pixel to the brightness of the second sub-pixel; and increase brightness of the first sub-pixel if the brightness ratio of the first sub-pixel is greater than a set value, wherein the set value is greater than 0 and less than 1.

15. The apparatus as claimed in claim 14, wherein the set value is in a range between 65%-75%.

16. The apparatus as claimed in claim 14, wherein the processor is further configured to increase brightness of the first sub-pixel by a target brightness, wherein the target brightness, the brightness of the second sub-pixel, the brightness ratio, and the set value satisfy an equation of: the target brightness=the brightness of the second sub-pixel×(the brightness ratio−the set value)/2.

17. The apparatus as claimed in claim 12, wherein the OLED screen displays a monochromatic display, and the first sub-pixel and the second sub-pixel are sub-pixels with a same color.

18. The apparatus as claimed in claim 17, wherein the processor is further configured to obtain data signals for sub-pixels driven by the at least two ICs; and determine whether the OLED screen displays a monochromatic display according to the data signals for the sub-pixels driven by the at least two ICs.

19. The apparatus as claimed in claim 12, wherein the OLED screen displays a non-monochromatic display, and the first sub-pixel and the second sub-pixel are sub-pixels with different colors.

20. The apparatus as claimed in claim 12, wherein odd rows of sub-pixels of the OLED screen are in an arrangement of R, G, B, and G, and even rows of sub-pixels of the OLED screen are in an arrangement of B, G, R, and G.

* * * * *